US005813832A

United States Patent [19]

Rasch et al.

[11] Patent Number: 5,813,832

[45] Date of Patent: Sep. 29, 1998

[54] TURBINE ENGINE VANE SEGMENT

[75] Inventors: L. Timothy Rasch, Fairfield; John P. Heyward, Loveland; Jeffrey J. Reverman, Cincinnati, all of Ohio

[73] Assignee: General Electric Company, Cincinnati, Ohio

[21] Appl. No.: 759,544

[22] Filed: Dec. 5, 1996

[51] Int. Cl.[6] ..... F01D 1/02

[52] U.S. Cl. ..... 415/200; 415/191

[58] Field of Search ..... 415/200, 191, 415/210.1, 209.4, 115; 29/889.1, 889.21, 889.22

[56] References Cited

U.S. PATENT DOCUMENTS

| | | | |
|---|---|---|---|
| 3,967,355 | 7/1976 | Giamei et al. | 29/889.1 |
| 4,305,697 | 12/1981 | Cohen et al. | 415/217 |
| 4,830,934 | 5/1989 | Ferrigno et al. . | |
| 5,173,255 | 12/1992 | Ross et al. . | |
| 5,343,694 | 9/1994 | Toborg et al. . | |
| 5,444,911 | 8/1995 | Goodwater et al. | 29/889.7 |
| 5,490,322 | 2/1996 | Goodwater et al. | 29/722 |
| 5,672,261 | 9/1997 | Whent et al. | 205/206 |
| 5,673,744 | 10/1997 | Bewlay et al. | 29/889.1 |
| 5,676,191 | 10/1997 | Bewlay et al. | 29/889.1 |

*Primary Examiner*—Thomas E. Denion
*Attorney, Agent, or Firm*—Andrew C. Hess; David L. Narciso

[57] ABSTRACT

A turbine engine vane segment, including spaced apart band or platform members and at least one airfoil member carried at metallic bonds between the platform members, is improved by providing at least one, but not necessarily all, of the segment members as an improved member having a directionally oriented Ni base superalloy microstructure with a stress rupture strength greater than the stress rupture strength of the balance of the segment members, which have a conventional generally equiaxed microstructure. For example, the balance of the members are conventionally cast from a Co base alloy. The coefficient of thermal expansion of the improved member is different from that of the balance of the members. A metallic bond including a brazed structure is provided between the improved member and the balance of the members, possessing strength sufficient to carry the stresses caused by differences in coefficients of thermal expansion of the dissimilar materials.

8 Claims, 1 Drawing Sheet

TURBINE ENGINE VANE SEGMENT

CROSS REFERENCE TO RELATED APPLICATION

This application is related to application Ser. No. 08/759,543—Reverman et al. for "Method and Apparatus for Repairing a Turbine Engine Vane Segment," and to application Ser. No. 08/759,545—Galley et al. for "Method for Bonding a Turbine Engine Vane Segment," both filed concurrently with this application.

BACKGROUND OF THE INVENTION

This invention relates to components of turbine engines, for example a vane segment of a turbine engine. More particularly, it relates to improvement of a gas turbine engine turbine vane segment which is intended to experience high temperature operation in the engine.

During operation in the hot section of a gas turbine engine, turbine vane segments which have been assembled into a vane assembly, sometimes called a nozzle or nozzle assembly, experience strenuous environmental conditions as well as thermal expansion and contraction resulting from thermal cycling of the engine. As a result of engine operation, vane segment members, particularly airfoils, can become worn or damaged to the point at which replacement or repair is required to maintain safe, efficient engine operation. Because such components in modern gas turbine engines are air cooled and of complex design, are made of relatively expensive materials, and are expensive to manufacture, it is desirable to provide the most vulnerable to damage of the segment members with the ability to avoid such damage. In addition, it is desirable to repair rather to replace members of existing turbine vane assemblies which have been damaged, for example, during engine operation, by providing an improved combination of members which will resist such damage in later operation.

An example of a gas turbine engine turbine nozzle or vane assembly, of the type to which the present invention relates, and showing the relationship of its members to one another and to the turbine engine is described in U.S. Pat. No. 5,343,694—Toborg et al., patented Sep. 6, 1994. The disclosure of such patent is hereby incorporated herein by reference.

BRIEF SUMMARY OF THE INVENTION

The present invention, in one form, relates to a turbine vane segment, comprising a plurality of segment members including at least one airfoil member and first and second spaced apart band members, sometimes called platforms. The airfoil member, carried between the spaced apart band members, is held at first and second airfoil ends at metallic bonds between the ends and the respective band members.

The present invention provides the improvement wherein at least one segment member, most frequently and typically an airfoil member, but not all segment members, is an improved member having a directionally oriented cast Ni base superalloy microstructure, for example a single crystal or directionally solidified multi-elongated grain microstructure. The Ni base superalloy has a first stress rupture strength and a first coefficient of thermal expansion. The balance of the segment members have a conventionally cast, substantially equiaxed alloy microstructure with a second stress rupture strength less than the first stress rupture strength and a second coefficient of thermal expansion different from the first coefficient of thermal expansion. Provided between the improved member and the balance of the segment members is a metallic bond which includes a brazed structure having a strength sufficient to carry, and resist deformation from, stresses applied as a result of different coefficients of thermal expansion of the members when heated and subsequently cooled during engine operation.

In one form, the improved member is cast from the Ni base superalloy and the balance of the members are Co base alloy castings. In another form, the metallic bond is a combination of intermittently spaced apart tack welds and a brazed structure about the tack welds to define the metallic bond.

BRIEF DESCRIPTION OF THE DRAWING

The drawing is a perspective view of a turbine engine turbine vane segment including a pair of airfoil members carried between inner and outer platform members.

DETAILED DESCRIPTION OF THE INVENTION

Figure 1:
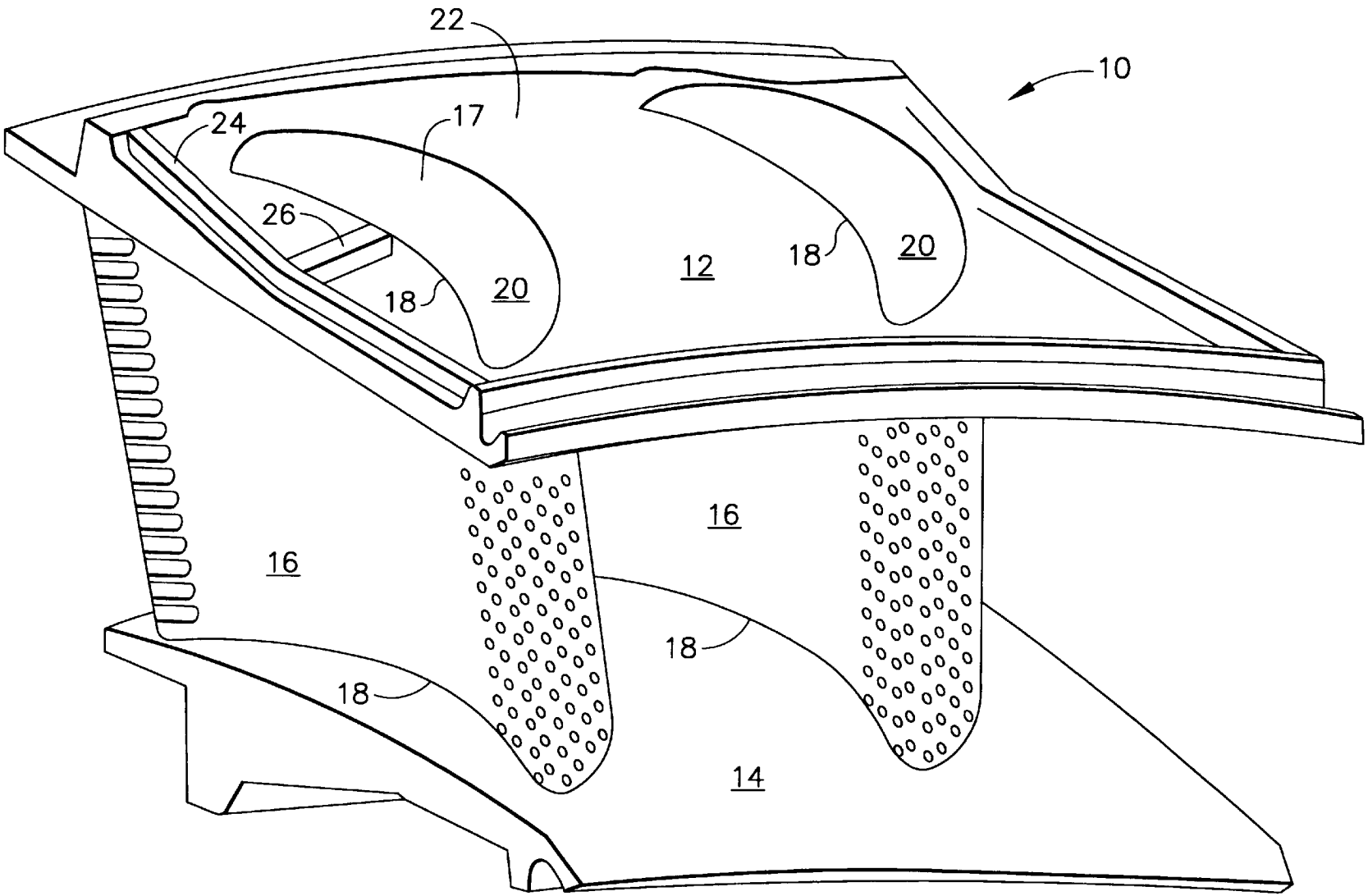

Gas turbine engine manufactures have employed better, stronger materials in the original design of turbine engine components such as high pressure turbine members. These include directionally solidified or single crystal cast materials which have been seen to stay in service longer than conventionally cast materials. However, there are in gas turbine engine operation a large number of the older type of vane segments which are constructed entirely of conventionally cast members having a conventional, generally equiaxed microstructure. Because of the relatively high cost of such segments, when one or more members of the older type segment become damaged as a result of operation, it is much more desirable to repair the segment by replacing the damaged member rather than by replacing the entire segment.

Repairing the segment by replacing a damaged member has included first separating members of the segment and then reassembling the segment with a repaired or replaced member, more frequently one or more airfoil members. One form of such a separation and replacement is described in U.S. Pat. 5,444 911—Goodwater et al., patented Aug. 29, 1995, the disclosure of which hereby is incorporated herein by reference. In such known repair methods, the replacement member has been of the same alloy and microstructure as the member it has replaced. For example, in current use in some turbine vane assemblies are conventional, generally equiaxed microstructure castings of Co base alloys, such as the well known X-40 alloy. When a member such as an airfoil is replaced during repair, the replacement member has been a substantial duplicate of the member being replaced, both in alloy and microstructure.

The present invention provides an improved turbine engine vane segment by replacing the damaged member with an improved member of substantially the same design but having mechanical properties greater than those of the member it has replaced. This provides the member with significantly greater resistance to subsequent damage during engine operation. Such greater properties are provided, according to the present invention, by casting the improved replacement member of a Ni base superalloy having a directionally oriented microstructure. Such a microstructure includes single crystal as well as directionally solidified multi-elongated grain structures of the types widely reported and used in the gas turbine art. One such alloy and structure is discussed in U.S. Pat. No. 4,169,742—Wukusick et al., patented Oct. 2, 1979, the disclosure of which hereby is incorporated herein by reference.

The present invention, in one specific form, provides an improved member, such as an airfoil, as a replacement for a conventionally cast Co base alloy damaged member, cast from a Ni base superalloy to have a directionally oriented microstructure and mechanical properties greater than the mechanical properties of the damaged member. Because the alloys and microstructures of such combination of members in the improved vane segment are different, their coefficients of thermal expansion are different. When bonded together into a vane segment, the differences in thermal expansion characteristics must be considered, as discuss below in connection with the bond between such members.

The invention will be more clearly understood by reference to the drawing which is a perspective view of a turbine engine turbine vane segment, shown generally at 10, including a pair of airfoils 16 carried between outer and inner bands or platforms 12 and 14, respectively. Outer band 12 includes a radially outward or non-airflow surface 22 and an airfoil shaped opening 17. The airfoils 16 include airfoil ends 20 which are carried at metallic bonds 18 at junctures between the inner and outer bands or platforms. The present invention, in one form, provides an improved vane segment including, as an improved member, one or more airfoils 16 of a Ni base superalloy having a directionally oriented microstructure and a stress rupture strength greater than that of platforms 12 and 14. Because of the above-mentioned differences in coefficients of thermal expansion between the different alloys and microstructures of the replacement, improved airfoil or airfoils and the platforms, the bonds 18, according to the invention, are metallic bonds having a brazed structure and of strength sufficient to carry the stresses applied during expansion and contraction of the members during engine operation and cycling and avoid significant detrimental distortion of the members. In one form, the metallic bonds are a combination of separate tack welds intermittently spaced about the juncture between the airfoil and the platform, and of a brazed structure about the tack welds at the juncture.

During evaluation of the present invention, a gas turbine engine high pressure turbine vane nozzle segment as in the drawing, including the segment members of inner and outer platforms and a pair of airfoils carried and bonded therebetween, was evaluated for repair after engine operation. All of the members of the segment were conventionally cast of a commercially available Co base alloy, sometimes called X-40 alloy, and having a generally equiaxed microstructure. Properties of the X-40 alloy included an average stress rupture strength of about 10500 psi at 1800° F. and 100 hours, and a coefficient of thermal expansion of about $9.2\times10^{-6}$ in/in/°F. It was concluded that the airfoil members were damaged and that replacement of the airfoil members was required for safe, efficient engine operation.

The damaged airfoils were separated from the platforms by mechanically cutting off the airfoils near the platforms and resizing airfoil shaped opening in the platforms to receive replacement airfoils. According to the present invention, the replacement airfoils were improved members to provide the vane segment with improved strength, operating life and resistance to operating wear or damage. The improved airfoils had the same shape and design of the damaged airfoils but were cast from a Ni base superalloy having a directionally oriented microstructure to provide greater mechanical properties than the X-40 alloy structure. The Ni base superalloy used for the improved member was the type described in U.S. Pat. No. 5,173,255—Ross et al., patented Dec. 22, 1992, the disclosure of which hereby is incorporated herein by reference. Properties of that Ni base superalloy, sometimes referred to as directionally solidified Rene' 142 alloy (DSR 142 alloy), included an average stress rupture life of about 300% greater than that of the above described X-40 Co base alloy which it replaced. In addition, it had a coefficient of thermal expansion of about $7.7\times10^{-6}$ in/in/°F., different from and less than the coefficient of thermal expansion of the X-40 alloy. This difference in thermal expansion characteristics of the dissimilar materials required attention to the bond between the improved Ni base airfoil members and the Co base alloy platform members with which they were to be joined: the bond would have to possess strength sufficient to carry stresses applied from such differences to avoid significant detrimental distortion, such as bowing, buckling, or cracking of the members or joints therebetween, during subsequent engine operation.

One form of such metallic bond between segment members, in the above example, used a brazing material including a mixture of a plurality of Ni base and Co base alloy powders, of the type described in U.S. Pat. No. 4,830.934—Ferrigno et al., patented May 16, 1989, the disclosure of which hereby is incorporated herein by reference. Such a brazing material sometimes is referred to as SA 650 material. Prior to bonding, the replacement, improved Ni base alloy airfoil members were assembled in reshaped airfoil shaped openings of the Co base platform members from the original vane segment. While such members of the segment were held in a proper design relationship, a series of intermittent conventional tungsten inert gas (TIG) tack welds, for example about 3 or 4 about each juncture, were made to bond, preliminarily, the improved airfoil members to the platforms. Thereafter, the above described brazing mixture of powders was disposed about the junctures, including at the tack welds, and then heated to bond the members by brazing at the junctures. The resulting bond included a brazed structure which is believed to have a coefficient of thermal expansion between that of the X-40 Co base alloy and that of the DSR 142 Ni base superalloy to accommodate differences in thermal expansion and contraction of the members during engine operation and cycling.

Additionally in this example, strengthening structural member or ribs 24 and 26 were added to surface 22 of outer band 12 to assist the band 12 in carrying the stresses, and resisting distortion, caused by the differing coefficients of thermal expansion at the operating temperature and cycle of the vane segment. Rib 24 extended substantially axially along the radially outward or non-airflow surface 22 of the outer band 12. Rib 24 was a wire of the commercially available L-605 Co base alloy which was tack welded to the surface by the commercial Tungsten Inert Gas (TIG) welding process, then further bonded to such surface with the SA-650 bonding material. Rib 26 extended substantially circumferentially on surface 22 from rib 24 toward airfoil shaped opening 17. Rib 26 was a wire of L-605 alloy TIG welded to surface 22.

The improved turbine engine vane segment combination of the present invention can increase the life of such components originally made of conventionally cast alloys and provide improved engine performance over a longer period of time, without changing the design of the component. Performance is improved because the improved member has greater stress rupture strength and higher resistance to creep during operation. This allows such features as the trailing edges of airfoils to remain in the same position relative to supporting platforms during engine operation. This is opposed to the conventionally cast airfoils, which can creep and bow during operation, resulting in engine performance losses. The present invention has been described in connection with specific examples and embodiments. However, it will be understood by those skilled in the art that these are typical of, rather than limitations on, the invention which is capable of variations and modifications without departing from the scope of the appended claims.

We claim:

1. An improved turbine engine vane segment comprising a plurality of segment members including at least one airfoil member and first and second spaced apart band members including an airfoil shaped opening, the airfoil member being carried between the spaced apart band members, the airfoil member being held at airfoil ends with the first and second band members at metallic bonds therebetween, the improvement wherein:

at least one segment member, but not all segment members, is an improved member having a directionally oriented cast Ni base superalloy microstructure with a first stress rupture strength and a first coefficient of thermal expansion;

the balance of the segment members having a conventionally cast substantially equiaxed alloy microstructure with a second stress rupture strength less than the first stress rupture strength and a second coefficient of thermal expansion different from the first coefficient of thermal expansion; and, a metallic bond is provided between the improved member and the balance of the segment members, the bond including a brazed structure having a strength which will carry stresses applied during expansion and contraction of the members having the differing first and second coefficients of thermal expansion at the bond without significant detrimental distortion of the segment members.

2. The segment of claim 1 in which the first coefficient of thermal expansion of the Ni base superalloy is less than the second coefficient of thermal expansion.

3. The segment of claim 1 in which the brazed structure of the metallic bond includes a plurality of spaced apart tack welds.

4. The segment of claim 1 in which:

the improved segment member is an airfoil member; and, the balance of the segment members is made of a Co base alloy.

5. The segment of claim 4 in which the Co base alloy is X-40 alloy.

6. The segment of claim 1 in which a band includes at least one strengthening member bonded to a non-airflow surface of the band.

7. The segment of claim 6 in which:

the non-airflow surface is on the outer band; and, the strengthening member is a first rib extending substantially axially along the non-airflow surface.

8. The segment of claim 7 in which a second strengthening rib extends substantially circumferentially on the band non-airflow surface from the first rib toward the airfoil shaped opening in the outer band.

* * * * *